United States Patent [19]

Cho

[11] Patent Number: 5,063,326

[45] Date of Patent: Nov. 5, 1991

[54] DYNAMIC FOCUS ELECTRON GUN

[75] Inventor: Suk-rae Cho, Suwon, Rep. of Korea

[73] Assignee: Samsung Electron Devices Co., Ltd., Japan

[21] Appl. No.: 465,494

[22] Filed: Jan. 16, 1990

[30] Foreign Application Priority Data

Mar. 9, 1989 [KR] Rep. of Korea ..... 89-2899

[51] Int. Cl.[5] ..... H01J 29/58

[52] U.S. Cl. ..... 313/414

[58] Field of Search ..... 313/414

[56] References Cited

U.S. PATENT DOCUMENTS 4,366,419 12/1982 Barten ..... 315/382

4,886,999 12/1989 Yamane et al. ..... 313/414

FOREIGN PATENT DOCUMENTS 53-9464 1/1978 Japan .

*Primary Examiner*—Sandra L. O'Shea

*Attorney, Agent, or Firm*—Leydig, Voit & Mayer

[57] ABSTRACT

A dynamic focus electron gun includes a triode for initially forming electron beams and a main lens for focusing and accelerating the electron beams with dynamic electric fields, wherein the main lens includes an auxiliary electrode including three cylindrical members, each including an electric field introducing window aperture for introducing electric fields into the members and an oblong tubular electrode commonly surrounding the members and covering the electric field introducing windows. According to the present invention, interference between the electron beams can be avoided, and the focus of the electron beams can be optimized.

4 Claims, 3 Drawing Sheets

DYNAMIC FOCUS ELECTRON GUN

FIELD OF THE INVENTION

The present invention relates to a dynamic focus electron gun and, particularly, to an improved dynamic focus electron gun in which the electrodes for establishing the dynamic electric fields in the main lens are improved.

BACKGROUND OF THE INVENTION

The electron gun of FIG. 1 which was developed by Matsushita Electric Corporation of Japan and the electron gun of FIG. 2 which was developed by NEC company of Japan are typical dynamic focus electron guns. The common characteristics of these two electron guns lie in the fact that the electron beams are vertically elongated by means of a dynamic quadrupolar lens, thereby compensating for the degradation of the beam spot characteristics caused by the distortion of the deflecting magnetic field.

In the case of the electron gun of Matsushita, vertical and horizontal blades BV, BH for forming a quadrupolar lens are disposed at both the beam exiting plane 3P of an electrode G3 to which a static focus voltage is applied and at the beam entrance plane 4P of an electrode G4 to which a dynamic focus voltage is applied. The bladesd BV, BH are installed projecting from the respective planes toward the other electrode surrounding the respective red, green, and blue (R.G.B.) electron beam passages.

In the case of the electron gun of NEC company, vertically elongate beam passing holes G3H and horizontally elongate beam passing holes G4H are disposed at the beam exiting plane 3P of an electrode G3 to which a static focus voltage Vf is applied and at the beam entrance plane 4P of an electrode G4 to which a dynamic focus is applied voltage Vd.

In these two electron guns, a parabolic dynamic focus voltage Vd synchronized with the vertical and horizontal scanning signals is applied to the electrode G4. Therefore, the electron beams are vertically elongated when the electron beams are scanning the peripheral portions of the screen, that is, during the time when the electron beams are deflected at a large angle by the deflecting yoke, with a large astigmatism. Therefore, when the vertically elongated electron beams land on the screen after passing through the deflecting magnetic field, they form approximately circular spots. As a result, beam spots of a uniform shape are distributed over the whole surface of the screen, thereby greatly improving the quality of picture.

In such electron guns having the above described advantages, a dynamic electric field is formed between pairs of mutually opposingly facing electrodes, and therefore, the manufacturing process for the electron gun requires high precision. Dynamic electric fields are established between pairs of electrodes having certain potential differences, and therefore, the intensities of the electric fields are very sensitive to the dimension of the gaps between the pairs of the electrodes and are liable to be varied by variations in the dimensions of the gaps.

In the case of the electron gun of NEC company, there is a likelihood that the uniformity of the field intensity can be impaired by by non-planar deviations of the beam exiting plane 3P of the electrode G3 and of the beam entrance plane 4P of the electrode G4. In the case of the electron gun of Matsushita, the field intensity can vary depending on the assembly precision of the vertical blades BV and the horizontal blades BH. Further, in the case of the electron gun of Matsushita, the vertical and horizontal blades are closely spaced in a rectangular relationship surrounding the beam passages. Therefore, arcing might occur due to the potential differences.

SUMMARY OF THE INVENTION

The present invention overcomes the above described disadvantages of the conventional techniques.

Therefore, it is the object of the present invention to provide a dynamic focus electron gun in which the dynamic electrode is stabilized, and the electron beam focus obtained through the dynamic electric fields is improved.

To achieve the above objects, the dynamic focus electron gun of the present invention comprises a triode means for initially forming electron beams and a main lens for focusing and accelerating the electron beams by means of dynamic electric fields wherein the main lens includes an auxiliary electrode comprising three cylindrical members, each member including an electric field introducing window aperture for introducing an electric field and an oblong tubular electrode commonly surrounding said cylindrical members.

Thus, when the R.G.B. electron beams pass through the main lens, the beams passing separately through the respective three cylindrical members are separately controlled within the respective cylindrical members. A guadrupolar lens is formed in each of the cylindrical members, because of the introducing effect of the electric fields, thereby achieving the intended optimum state of the beam spots.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENTS

Figure 1:
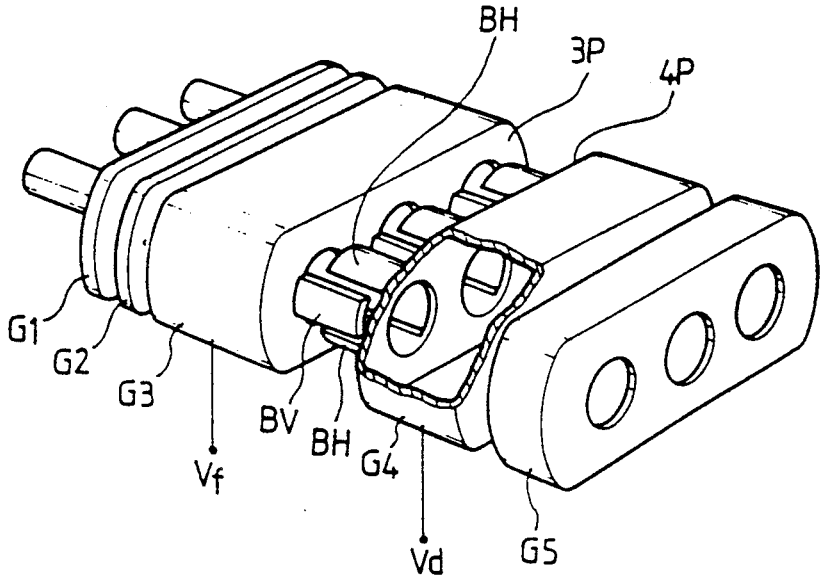
FIG. 1 (Prior Art)
FIGS. 1 and 2 are perspective views of the conventional dynamic focus electron guns.
Figure 2:
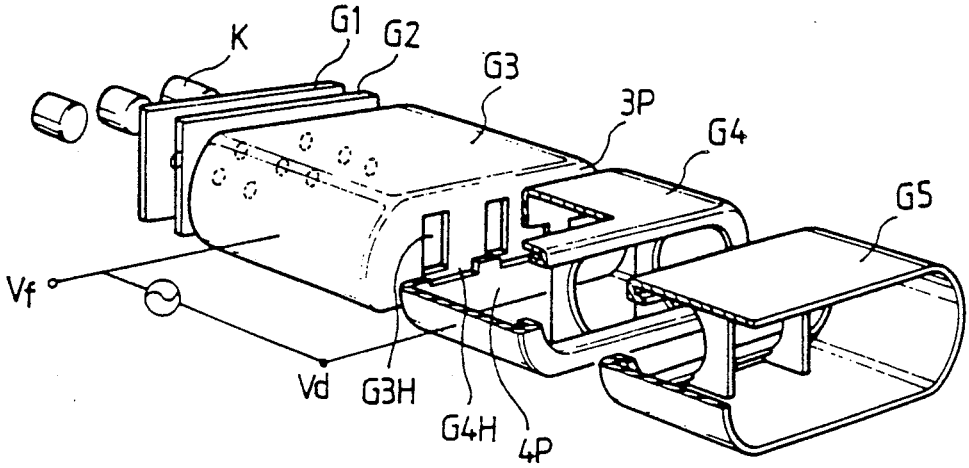
FIG. 2 (Prior Art)
Figure 3:
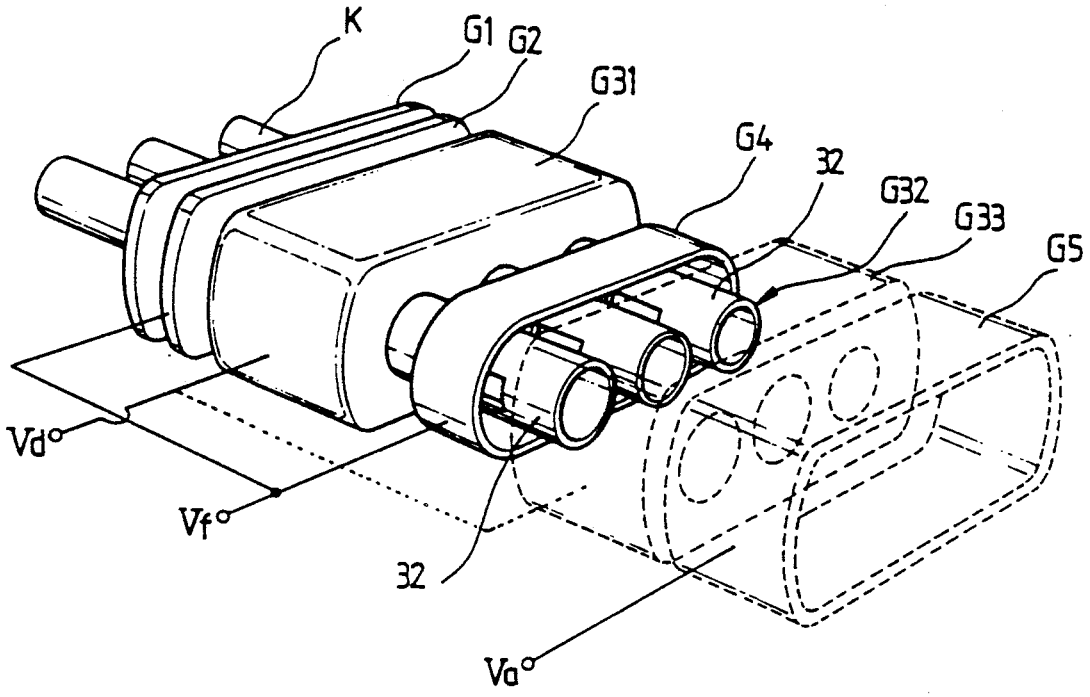
FIG. 3 is a perspective view showing an embodiment of the dynamic focus electron gun according to the present invention.

FIG. 3 illustrates a uni-bi-potential focus electron gun including dynamic electrodes G31, G33 and a triode means consisting of a cathode K, a control grid G1, and a screen grid G2. A main lens includes electrodes G31, G4, G33, and G5 arranged in the cited order. Further, the electrodes G31, G33 are commonly mounted through a cylindrical auxiliary electrode G32 inserted therebetween. The auxiliary electrode G32 comprises three cylindrical members 32 to which a parabolic dynamic focus voltage synchronized with the vertical and horizontal deflecting signals are applied.

Figure 4:
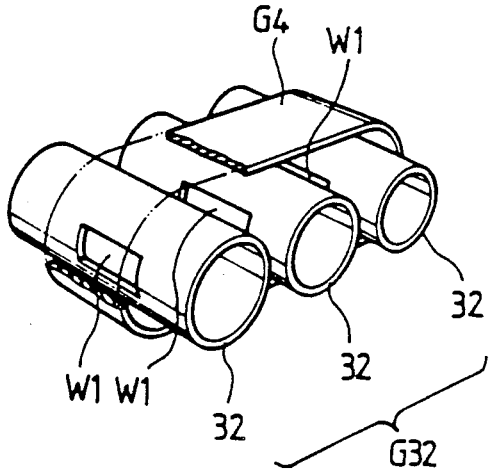
FIG. 4 is a perspective view of a static auxiliary electrode and a dynamic auxiliary electrode extracted from FIG. 3.

The electrode G4 has a shape of an oblong tube surrounding the cylindrical members of the electrode G32. Field introducing window apertures W1 are formed in the cylindrical members of said auxiliary electrode G32 and are surrounded by the electrode G32 as shown in FIG. 4. A static focus voltage Vf, which is the minimum voltage of said dynamic focus voltage Vd, is applied to the electrode G4. The electrode G5 finally focuses and accelerates the electron beams and receives a positive voltage of the highest level.

Figure 5:
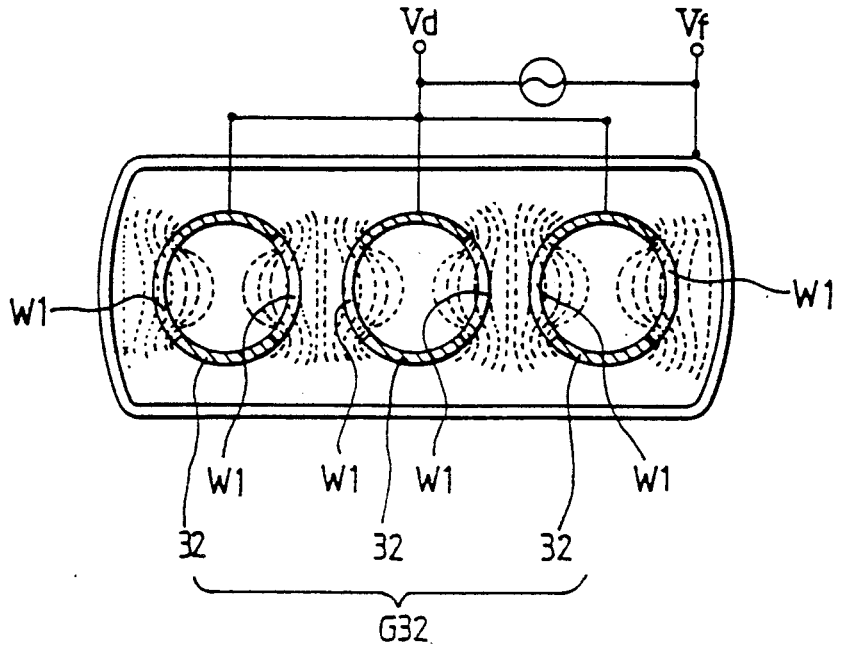
FIG. 5 is a vertical sectional view of the static auxiliary electrode and the dynamic auxiliary electrode shown in FIG. 4 illustrating the formation of an electric field.

The dynamic uni-bi-potential focus electron gun of the present invention as described above forms far more effective dynamic electric fields by means of the novel electrodes. When the R.G.B. electron beams formed in the triode are respectively separately passing through the three cylindrical members 32 of the auxiliary electrode G32 after passsing through the electrode G31, the beams are influenced by the electric fields which are introduced through the electric field introducing windows W1 of the auxiliary electrodes G32. As shown in FIG. 5, if a potential difference is established between the auxiliary electrodes G32 receiving a dynamic focus voltage and the electrodes G4 receiving a static focus voltage, then a quadrupolar electrostatic lens is formed within each cylindrical member 32 of the auxiliary electrodes G32 so that the electron beams can be vertically or horizontally elongated depending on the direction of the electromagnetic fields.

In the present embodiment, the electron beams are vertically elongated because the dynamic focus voltage Vd is applied to the electrode G4.

Figure 6:
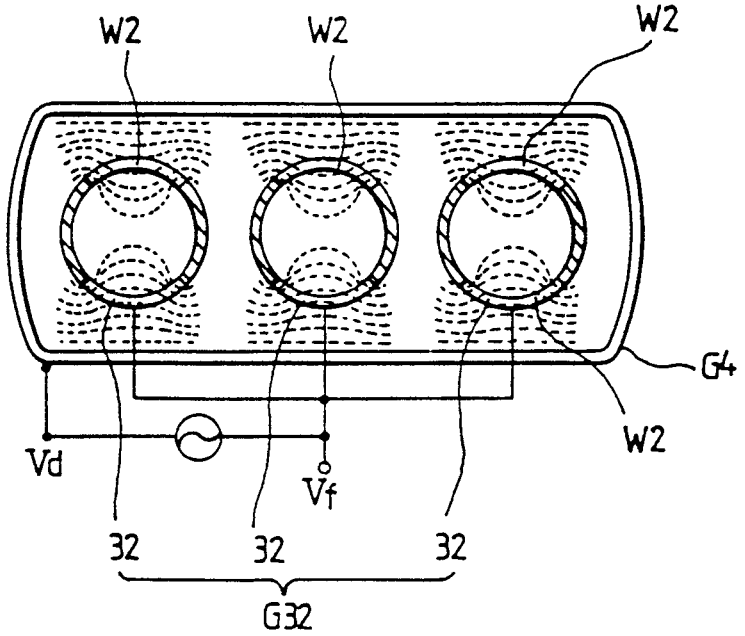
FIG. 6 is a vertical sectional view of the static auxiliary electrode and the dynamic auxiliary electrode according to another embodiment of the present invention presented in the same form as that of FIG. 5.

Another embodiment of the present invention in which an auxiliary electrode comprising three cylindrical and an oblong tubular auxiliary electrode are provide is illustrated FIG. 6. However, unlike in the first ebodiment described above, an electric field introducing window W2 is formed on each cylindrical member 32 of auxiliary electrode G32 in the vertical direction. Also in contrast to the first embodiment, a static focus voltage Vf is applied to the cylindrical members of the auxiliary electrode G32, while a dynamic focus voltage Vd is applied to the oblong tubular electrode G4. Consequently, a quadrupolar lens for of vertically elongating the electron beams is formed by means of the electrons G32, G4, with the result that the same advantage of the first embodiment is obtained.

The electron gun provided with the electrodes as described above and as shown in FIG. 3 can be modified depending on the application and the design conditions of the electron gun. The same structure may be applied for vertically elongating the electron beams by means of the cylindrical auxiliary electrode having the electric field introducing windows and the oblong tubular electrode surrounding said cylindrical auxiliary electrode, thereby obtaining focus characteristics which are superior to those of conventional electron guns.

As described above in detail based on the different embodiments, in the electron gun of the present invention, in which the astigmatism caused by the deflecting magnetic fields is compensated for by vertically elongating the electron beams, the dynamic electric fields for controlling the R.G.B. electron beams are formed within cylindrical auxiliary electrodes isolated from the outside, thereby maintaining the focus of the electron beams is an optimum state. The R.G.B. electron beams and the electric fields controlling them are respectively located in independent regions so that mutual interference phenomenon can be excluded and the electron beams can be optimally controlled. The electron gun of the present invention can be modified to various forms. The present invention is not limited to the simple uni-bi-potential focus electron gun, but its application may be extended to electron guns of large cathode ray tubes.

What is claimed is:

1. A dynamic focus electron gun comprising:

a triode for initially forming at least one electron beam; and a main lens for focusing and accelerating the electron beam with dynamic electric fields including an auxiliary electrode comprising at least one cylindrical member including an electric field introducing window aperture for introducing an electric field into the auxiliary electrode and an oblong tubular electrode surrounding said member opposite said electric field introducing window aperture of said cylindrical member of the auxiliary electrode.

2. The electron gun of claim 1 comprising a triode for forming three electron beams, said auxiliary electrode including a cylindrical member for each beam, each member including a window aperture, wherein said oblong tubular electrode commonly surrounds the three members opposite their respective window apertures.

3. The electron gun of claim 2 wherein said main lens includes first and second dynamic electrodes and said auxiliary electrode is disposed between and connecting said first and second dynamic electrodes.

4. The electron gun of claim 3 wherein said oblong tubular electrode is disposed between and electrically isolated from said first and second dynamic electrodes.

* * * * *